United States Patent [19]

Bernasconi et al.

[11] Patent Number: 4,758,360

[45] Date of Patent: Jul. 19, 1988

[54] PROCESS FOR SYNTHESIZING OVERBASED ADDITIVES UNDER CONSTANT PRESSURE OF CARBON DIOXIDE

[75] Inventors: Christian Bernasconi, Vernaison; Henri Grangette, Lyons; Francois Travers, La Talaudiere; Anne-Christine Trompette, Villeurbanne, all of France

[73] Assignee: Elf France, Courbevoie, France

[21] Appl. No.: 910,947

[22] Filed: Sep. 24, 1986

[30] Foreign Application Priority Data

Oct. 3, 1985 [FR] France ..... 85 14662

[51] Int. Cl.[4] ..... C10M 105/08

[52] U.S. Cl. ..... 252/33; 252/18; 252/25; 252/33.4

[58] Field of Search ..... 252/39, 18, 25, 33, 252/33.2, 33.4, 40.7

[56] References Cited

U.S. PATENT DOCUMENTS

| | | | |
|---|---|---|---|
| Re. 32,235 | 8/1986 | Forsberg | 252/39 |
| 3,567,637 | 3/1971 | Sabol | 252/39 |
| 3,595,790 | 7/1971 | Norman et al. | 252/39 |
| 3,629,109 | 12/1971 | Gergel et al. | 252/39 |
| 3,853,774 | 12/1974 | Crocker | 252/25 |
| 3,928,216 | 12/1975 | Saunders et al. | 252/18 |
| 4,049,560 | 9/1977 | Dominey | 252/25 |
| 4,171,558 | 10/1979 | Igrashi et al. | 252/39 |
| 4,192,758 | 3/1980 | Dickey et al. | 252/25 |
| 4,253,976 | 3/1981 | Forsberg | 252/39 |
| 4,306,983 | 12/1981 | Allain et al. | 252/25 |
| 4,347,147 | 8/1982 | Allain | 252/25 |

*Primary Examiner*—William R. Dixon, Jr.
*Assistant Examiner*—Margaret B. Medley
*Attorney, Agent, or Firm*—Burgess, Ryan & Wayne

[57] ABSTRACT

The present invention relates to a process for the synthesis of overbased additives obtained by carbonation under constant pressure of carbon dioxide, the process consisting of carbonating a reaction mixture comprising a derivative of an alkaline-earth metal and at least one surfactant in a diluent oil and a hydrocarbon solvent in the presence of an oxygeneous accelerator and a nitrogeneous accelerator, while maintaining a constant pressure of carbon dioxide above the reaction mixture, the carbon dioxide is thus progressively introduced as it is consumed, thereby allowing its concentration in the liquid medium not to become too high which could thereafter provoke the formation of insoluble over-carbonated products, the reaction to be self-controlled and to obtain excellent yields of overbased products having very high alkaline values and alkaline-earth contents, while however remaining fluid and stable.

19 Claims, No Drawings

PROCESS FOR SYNTHESIZING OVERBASED ADDITIVES UNDER CONSTANT PRESSURE OF CARBON DIOXIDE

FIELD OF THE INVENTION

1. Background of the Invention

The present invention relates to a process for the synthesis of overbased additives having a high alkaline value by carbonation under constant pressure of carbon dioxide.

Overbased additives are alkaline-earth metal salts of organic acids, overbased by carbonation with carbon dioxide. The term "overbased" is used to designate the excess of alkaline-earth metal with respect to the stoechiometric quantity necessary to neutralize the organic acid used.

These overbased additives have been used in lubricating oils for many years. They have the property of overcoming the acidity formed in engines by the combustion of sulfurated organic derivatives contained in the gasolines as well as by oxidation of the components of the oils that occurs during operation of land vehicle engines or marine engines.

The increasing use of sulfurated combustibles, in particular for fuel or heavy fuel motors, and the progressively stricter operating conditions, renders indispensable the use of lubricating compositions able to neutralize the large quantities of acids formed during combustion.

The overbased additives are also applied as anti-corrosion agents in burner boilers using heavy fuel since they preferably chelate vanadium oxide present in heavy fuels. This compound which is deposited on the walls of the furnaces during burning is the cause of the oxidation and the corrosion of these furnaces. The alkaline-earth metal oxides and especially the magnesium oxide form high melting point eutectics with the vanadium oxides and sodium oxides which do not stick to the walls of the furnace pipes.

The basicity of these overbased products is characterized by their alkaline value (AV) which is nominally equivalent to the number of milligrams of KOH per gram of overbased additive titrated by a strong acid.

The overbased additives must have high alkaline values, generally higher than or equal to 250. Thereafter, the viscosity of these products must be sufficiently low to facilitate their handling and use. Furthermore, they must be translucid, without traces of mineral compounds in suspension. The suspended solids are prejudicial to the effect desired since they cause abrasion of the engines and burners and precipitate in the medium thereby leading, on the one hand, to undesirable sediments and, on the other hand, to an inhomogeneity in the concentration of metal content.

Furthermore, they must preserve their limpid appearance and maintain a homogeneous and constant consistency with time.

2. Description of the Prior Art

Numerous processes for preparing overbased additives already exist.

European patent application No. 005337 describes a process which consists in carbonating an alkylarylsulfonate and magnesium oxide mixture in a diluting oil and xylene, in the presence of methanol, water and ammonia.

According to British patent application No. 2,055,885A, replacing methanol by ethoxyethanol allows one to obtain overbased products of reduced viscosity (203 cSt at 210° F.).

British patent applications Nos. 2,114,993A and 2,037,310A, European patent application No. 013,807A and French patent published under No. 2,528,224 claim the substitution of methanol by respectively dioxolan, a methanol-carboxylic acid mixture, a methanol-diacetone mixture or glycols.

Furthermore, U.S. Pat. No. 4,347,147 claims the use of ethylenediamine as a substituent for ammonia.

U.S. Pat. No. 3,928,216 proposes a method of carbonation without the addition of water.

According to European patent application No. 005 337, the speed of carbonation is determined for each composition by a series of tests. Not only is this process time consuming, but as in other processes according to the prior art, the rate of introducing the carbon dioxide is constant. It is therefore not optimal throughout the whole duration of the reaction.

Too slow an introduction rate leads to poor use of the reactor. In the case of too rapid or too slow introduction of the carbon dioxide, the alkaline-earth carbonate precipitates and the viscosity increases prohibitively.

SUMMARY OF THE INVENTION

A process has now been developed that allows one to overcome this drawback and to obtain in a reproductible and simple manner overbased additives having a high alkaline value and satisfactory viscosity.

The synthesis process of overbased additives according to the invention consists in carbonating a reaction mixture comprising an alkaline earth metal derivative and at least one surfactant in a diluent oil and a hydrocarbon solvent in the presence of an oxygeneous accelerator and a nitrogeneous accelerator, wherein the introducing rate of the carbon dioxide is controlled by the speed of the reaction.

A constant pressure of carbon dioxide is maintained above the reaction mixture by replacing carbon dioxide progressively as it is consumed, so that the reaction is self-adjusting.

The carbon dioxide can be introduced into the reactor below the level of the liquid that constitutes the reaction mixture by bubbling but according to a preferred manner of carrying out the invention, the carbon dioxide is introduced into the reactor above the level of the reaction mixture and the pressure is maintained constant. In any event, the carbon dioxide is replaced progressively as it is consumed.

The constant pressure used can vary between about 1.01 and 3 bars absolute and preferably between 1.01 and 1.5 bars absolute.

Among the alkaline-earth metals are preferably used calcium or magnesium in the hydroxide or oxide form. The invention allows one to adapt the overbasing process to the use of different metals. Most commonly used are the calcium or magnesium oxides. The "light" oxides that have been calcinated at lower temperatures than the usual oxides generally have a better reactivity.

The surfactants are molecules composed of a hydrocarbonated lipophilic part and a hydrophilic part. The hydrophilic part can be a sulfonic acid, carboxylic acid, phenolic, phosphonic or thiophosphonic group. These compounds are used in the form of their metallic salts. On the contrary, the surfactants based on nitrogeneous compounds such as amines, amides, imines and imides do not require the presence of metallic atoms.

Among the surfactants, the most frequently used are the sulfonates and especially the alkylarylsulfonates. The alkylbenzenesulfonates, such as $C_{24}$-alkylbenzenesulfonates are most suitable.

The purpose of the diluent oil is to allow simple handling at ambient temperature. Among these dilution oils can be cited the paraffinic oils such as 75, 100 or 150 Neutral or naphthenic oils.

The hydrocarbonated solvent has an aliphatic or aromatic structure. The most currently used solvents are toluene, xylene, heptane, octane and nonane.

The oxygeneous accelerators are especially aliphatic alcohols, generally $C_1$ to $C_5$, the most frequently methanol, but also ethanol and glycols. Ethers such as dioxolan or dialkyloxymethane or even water are used, alone or mixed with an alcohol.

The nitrogeneous accelerators are among others ammonia, ethylenediamine, ethanolamines, ammonium chloride or ammonium carbonate.

According to one preferred application of the invention that, are introduced into a reactor an organic acid, generally of the alkylarylsulfonic acid type, an alkaline-earth metal derivative, generally magnesium or calcium oxide, which react in order to produce the corresponding surfactant salt, generally of the magnesium or calcium alkylarylsulfonate type, then 100 Neutral oil, an organic solvent such as xylene or heptane and the oxygeneous and nitrogeneous accelerators. The reaction mixture is strongly stirred and the reactor pressurized with carbon dioxide and the pressure is maintained constant. The reaction being exothermic, it is not necessary to heat.

The carbonation time is in function of the reaction agents used, of the stirring and the pressure employed. It is generally comprised between 2 and 6 hours. A reaction time of normally 3 to 5 hours is sufficient.

The overbased additive can be recovered after elimination of the solvents, by several distillations and a filtering to separate the products remaining in the solid state, in particular the non overbased alkaline-earth carbonates and the excess alkaline-earth oxides.

It is also possible to eliminate the solid residues through centrifugation followed by evaporation of the solvents. This process is described in a patent application filed the same day as that bearing filing No. 85 14664 and entitled: "Process for preparing very fluid overbased additives having a high basicity and compositions containing such additives".

The overbased product obtained is present in the form of a translucid fluid oil having a clear brown color.

It is characterized by its alkaline value (AV) determined by direct potentiometric measuring according to the standard ASTM D 2896, its content in alkaline-earth metal determined by plasma torch and its cinematic viscosity at 100° C.

The "overbased" products according to the invention are utilized as additives in lubricating oils having a natural or synthetic origin or, particularly in the case where the metal is magnesium, as vanadosodic anticorrosion agents against corrosion provoked by vanadium-rich heavy fuels, the products being introduced into the heavy fuel prior to combustion.

DESCRIPTION OF THE PREFERRED EMBODIMENTS

The following examples illustrate the invention without in any way limiting the same:

EXAMPLE 1

Into a 5 liter capacity reactor, is introduced:
600 g of $C_{24}$ benzene sulfonic acid
612 g of 100 Neutral oil
1 200 g of xylene
1 200 g of heptane
468 g of "light" magnesium oxide
240 ml of methanol
384 ml of ammonia (20%)

The reactor is stirred by means of an anchor type agitator rotating at 500 rpm which ensures an effective mixing.

The reactor, after blowing through the residual air, is subjected to a pressure of 1.05 bar of $CO_2$, the pressure is maintained constant due to a servo-control system.

A rise in temperature is noted progressively as the reaction progresses. Care must be taken not to exceed 55°-56° C., but any excessive cooling should be avoided. The reaction lasts 4 hours.

At the end of the reaction, the reaction mixture is separated into two phases. The surnagent organic phase is recovered and then centrifuged in order to eliminate the solid phase comprising essentially residual magnesium oxide and crystallized ammonium carbonate or magnesium carbonate.

After evaporation of the light solvents (xylene and heptane), about 1 850 g of a transparent mahogany colored liquid is recovered.

The alkaline value is measured by potentiometric dosage according to the standard AV=532 mg KOH/g.

The magnesium content is determined by plasma torch spectrometric method, % Mg=11.7.

The cinematic viscosity measured at 100° C. is 210 cSt.

EXAMPLE 2

The same operating conditions as those of example 1 are applied, with the exception that the reactor is at atmospheric pressure, the $CO_2$ is introduced into the reaction mixture by bubbling at a constant flow-rate of 1 l/mn.

From the beginning of the reaction, a rise in temperature up to 58° C. after 40 minutes is noted. The temperature then decreases progressively. The reaction is completed after 2 hours.

After centrifugation and evaporation of the solvents, 1 760 g of a viscous liquid is isolated of which the measured alkaline value is 420 mg KOH/g, the magnesium content is 9.5% and the viscosity at 100° C. is 1 500 cSt.

EXAMPLE 3

Into a 5 liter capacity reactor, is placed:
600 g of $C_{24}$ benzene sulfonic acid
620 g of 100 Neutral oil
1 200 g of xylene
1 200 g of heptane
684 g of calcium oxide
240 ml of methanol
400 ml of ammonia at 20%.

The reactor stirred under the same conditions as those described herein-above at 900 rpm is maintained at a $CO_2$ pressure of 1.05 bars. A rapid increase in temperature is noted that is maintained by cooling to 41° C. The reaction is completed after 3 and a half hours.

The organic phase is thereafter separated by centrifugation and is subjected to an evaporation in order to eliminate the solvents. 1 890 g of a slightly opalescent clear brown colored liquid is recovered. Its alkaline value is 400 mg KOH/g which corresponds to 14.8% of Ca and its viscosity at 100° C. is 120 cSt.

EXAMPLE 4

The same operating conditions as those set out herein-above in example 1 are adopted.

After blowing through the residual air the reactor is maintained at a pressure of 1.5 bars of $CO_2$.

A more rapid increase in temperature is observed which is maintained by cooling at 55° C.

The reaction is completed after 2 h 40.

A more rapid separation of the two phases is observed. The organic phase is isolated by centrifugation and the light solvents are evaporated. About 1 900 g of a brown transparent liquid is obtained having an alkaline value of 540 mg KOH/g corresponding to 11.8% of Mg and a viscosity of 170 cSt at 100° C.

EXAMPLE 5

Under operating conditions identical to those of examples 1 and 4, the reactor is subjected to a $CO_2$ pressure of 2.1 bars.

The temperature increases rapidly and is maintained by cooling at 60° C. After 2 hours, the reaction is completed and under the same operating conditions as indicated herein-above 1 800 g of a homogenous liquid having a brown color and an alkaline value of 520 mg KOH/g containing 11.5% of Mg and presenting a viscosity of 153 cSt at 100° C. is obtained.

We claim:

1. In a process for preparing an overbased alkaline earth metal additive by the reaction of carbon dioxide with a reaction mixture containing an alkaline earth metal derivative, at least one surfactant, a diluent oil, a hydrocarbon solvent, an oxygeneous accelerator and a nitrogeneous accelerator, in a reaction zone, the improvement which comprises: controlling the rate of addition of carbon dioxide, to the reaction zone, by the speed of the reaction of the carbon dioxide with the reaction mixture.

2. A process according to claim 1 wherein a constant pressure of carbon dioxide is maintained above the reaction mixture in the reaction zone by replacing carbon dioxide as it is consumed.

3. A process according to claim 1, wherein the carbon dioxide is introduced into the reaction zone above the level of the reaction mixture.

4. A process according to claim 1, wherein the carbon dioxide is introduced directly into the reaction mixture in the reaction zone.

5. A process according to claim 2, wherein the pressure is maintained at a value from 1.01 to 3 bars absolute.

6. A process according to claim 1, wherein the derivative of an alkaline-earth metal is selected from the group consisting of calcium hydroxide, calcium oxide, magnesium hydroxide and magnesium oxide.

7. A process according to claim 1, wherein the surfactant comprises at least one member selected from the group consisting of sulfonates, carboxylates, phenates, phosphonates and thiophosphonates.

8. A process according to claim 7, wherein the surfactant is an alkylarylsulfonate.

9. A process according to claim 8, wherein the alkylarylsulfonate is a $C_{24}$ alkylbenzenesulfonate.

10. A process according to claim 1, wherein the diluent oil is a paraffinic or naphthenic oil.

11. A process according to claim 1, wherein the hydrocarbon solvent is an aromatic solvent.

12. A process according to claim 1, wherein the hydrocarbon solvent is an aliphatic solvent.

13. A process according to claim 1, wherein the oxygeneous accelerator comprises at least one member selected from the group consisting of alcohol, water, and ether.

14. A process according to claim 1, wherein the nitrogeneous accelerator comprises at least one member selected from the group consisting of ammonia, ethylenediamine, ethanolamine, ammonium chloride and ammonium carbonate.

15. A process of claim 5 wherein the pressure is maintained at a value of from 1.01 to 1.5 bars absolute.

16. A process of claim 7 wherein the surfactant is formed in the reaction mixture of reaction of a corresponding acid with the derivative of an alkaline earth metal.

17. A process of claim 11 wherein the hydrocarbon solvent comprises at least one member selected from the group consisting of toluene and xylene.

18. A process of claim 12 wherein the hydrocarbon comprises at least one member selected from the group consisting of heptane, octane and nonane.

19. A process of claim 13 wherein the oxygeneous accelerator is selected from the group consisting of dioxolan and dialkoxymethane.

* * * * *